US005388163A

United States Patent [19]

Elko et al.

[11] Patent Number: 5,388,163

[45] Date of Patent: Feb. 7, 1995

[54] ELECTRET TRANSDUCER ARRAY AND FABRICATION TECHNIQUE

[75] Inventors: Gary W. Elko, Summit, N.J.; Michael M. Goodwin, Titusville, Fla.; Robert A. Kubli, Milford; James E. West, Plainfield, both of N.J.

[73] Assignee: AT&T Corp., Murray Hill, N.J.

[21] Appl. No.: 812,774

[22] Filed: Dec. 23, 1991

[51] Int. Cl.[6] ..... A04R 25/00

[52] U.S. Cl. ..... 381/191; 381/113; 381/116

[58] Field of Search ..... 381/173, 190, 191, 113, 381/202, 155, 116, 174, 203, 196, 195; 29/594, 609.1; 310/324; 181/170

[56] References Cited

U.S. PATENT DOCUMENTS

| | | | |
|---|---|---|---|
| 3,136,867 | 6/1964 | Brettell | 381/116 |
| 3,644,605 | 2/1972 | Sessler et al. . | |
| 3,652,932 | 3/1972 | Sessler et al. | 324/72 |
| 3,663,768 | 5/1972 | Madsen et al. | 179/111 |
| 3,705,312 | 12/1972 | Sessler et al. | 307/88 |
| 3,859,477 | 1/1975 | Skvor | 381/174 |
| 3,892,927 | 7/1975 | Lindenberg . | |
| 3,930,066 | 12/1975 | Ryan et al. | 427/79 |
| 4,056,742 | 11/1977 | Tibbetts | 381/173 |
| 4,339,683 | 7/1982 | Scott et al. | 310/364 |
| 4,413,161 | 11/1983 | Matsumoto et al. | 381/20 |
| 4,429,189 | 1/1984 | Berkley et al. | 179/111 |
| 4,429,191 | 1/1984 | Busch-Vishniac et al. | 179/111 |
| 4,429,192 | 1/1984 | Busch-Vishniac et al. | 179/111 |
| 4,429,193 | 1/1984 | Busch-Vishniac et al. | 179/111 |
| 4,434,327 | 2/1984 | Busch-Vishniac et al. | 179/111 |
| 4,468,530 | 8/1984 | Torgeson | 381/196 |
| 4,509,527 | 4/1985 | Fraden | 128/671 |
| 4,653,606 | 3/1987 | Flanagan | 181/145 |
| 4,697,334 | 10/1987 | Madsen et al. | 29/594 |
| 4,802,227 | 1/1989 | Elko et al. | 381/92 |
| 4,852,177 | 7/1989 | Ambrose | 381/154 |
| 4,983,318 | 1/1991 | Matsumoto et al. | 252/299.01 |
| 5,117,463 | 5/1992 | Oyaba et al. | 381/158 |

FOREIGN PATENT DOCUMENTS

| | | | |
|---|---|---|---|
| 3232772C1 | 12/1983 | Germany | H04R 19/01 |
| 0155700 | 7/1987 | Japan | 381/173 |
| 2138144A | 10/1984 | United Kingdom | A61B 5/005 |

*Primary Examiner*—Curtis Kuntz
*Assistant Examiner*—Huyen D. Le
*Attorney, Agent, or Firm*—Thomas A. Restaino; Kenneth M. Brown

[57] ABSTRACT

An electret transducer array and fabrication technique are disclosed. The array comprises a foil having a layer of insulating material and a layer of metal in contact therewith. The layer of metal comprises one or more discrete areas of metal which define the active areas of one or more transducers in the array. Electrical leads are coupled to the discrete areas of metal. By means of these leads, electrical signals produced by each transducer in response to incident acoustic signals may be accessed. The areas of metal may be formed by selectively removing metal from the foil, or by selective metal deposition. The layer of insulating material is electrostatically charged. The electret transducer array further comprises a porous backplate of sintered metal. The backplate further comprises a rough surface in contact with the layer of insulating material. The backplate serves as a common electrode for transducers of the array. A second backplate is provided positioned adjacent to the metal layer of the foil forming an air gap therewith. The second backplate provides, among other things, shielding from stray electromagnetic fields.

35 Claims, 2 Drawing Sheets

ELECTRET TRANSDUCER ARRAY AND FABRICATION TECHNIQUE

FIELD OF THE INVENTION

This invention relates to electret transducer arrays.

BACKGROUND OF THE INVENTION

Acoustic arrays comprising one or more discrete microphone transducers are useful in producing directional response characteristics. Arrays with such characteristics are particularly useful in noisy environments, wherein sources of sound to be detected and noise to be rejected are directionally distinct.

In providing desirable directional response characteristics, the number, shape, and location of microphone transducers in an array may vary significantly from application to application. Transducers of irregular or non-standard shape and size may be expensive to fabricate. Moreover, imprecise fabrication and location techniques may result in significant degradation of an array's response characteristics.

SUMMARY OF THE INVENTION

The present invention provides an electret transducer array and associated fabrication technique. According to an illustrative embodiment of the invention, an electret transducer array is fabricated by providing an electret foil which comprises a layer of insulating material electrostatically charged and a layer of metal. The foil is placed on a backplate of sintered metal such that the charged insulating layer is in contact with the surface of the backplate. The backplate forms a common electrode for the transducers of the array. The layer of metal on the foil comprises one or more discrete areas of metal which define the shape, size and location of the active areas of one or more transducers in the array. These discrete areas of metal form electrodes for the individual transducers of the array.

DETAILED DESCRIPTION

Figure 1:
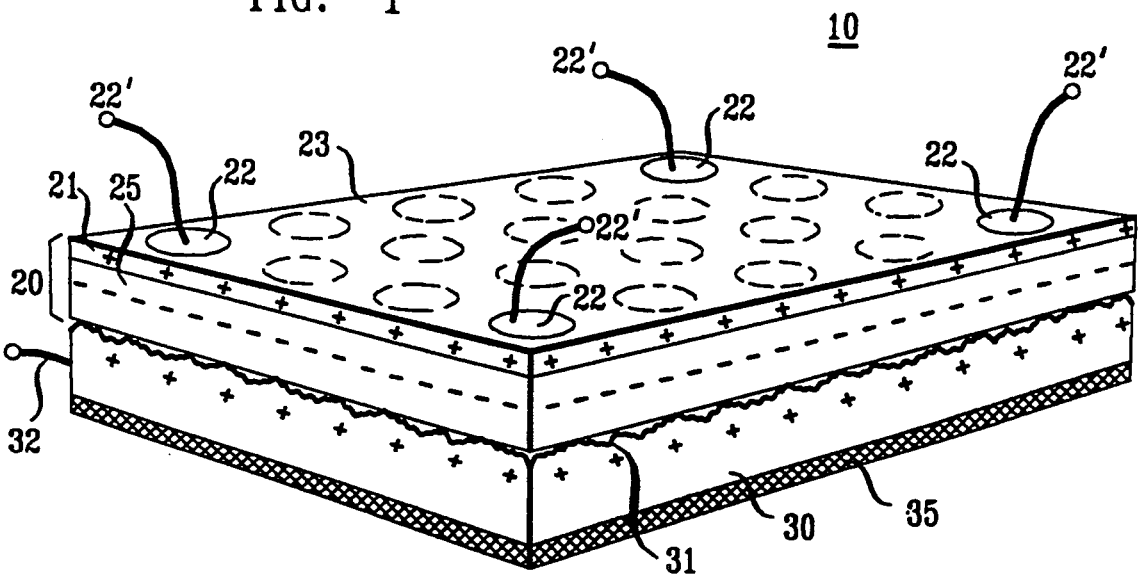
FIG. 1 presents an illustrative transducer array according to the present invention.

An illustrative electret transducer array 10 according to the present invention is presented in FIG. 1. The array 10 comprises electret foil 20 and a backplate 30. The electret foil 20 is flexible. It comprises two layers, a metal (such as aluminum) layer 21 and a synthetic polymer (such as PTFE TEFLON®) layer 25. The metal layer 21 may be, e.g., two thousand Angstroms thick, while the polymer layer 25 may be, e.g., between 2–100 microns thick. The polymer layer 25 is given a permanent charge (electret) to a predetermined value at, e.g., −300 volts, by conventional techniques. Charge is shown in the Figure as a series of "minus signs" (i.e., "−") indicating a negative electrostatic charge. Positive compensating charge exhibited by backplate 30 and metal layer 21 of foil 20 is presented as a series of "plus signs" (i.e., "+").

Backplate 30 is porous, and may comprise a sintered metal, such as sintered aluminum. Use of a sintered metal provides a rough surface 31 with numerous air channels throughout the backplate 30. The backplate 30 may be open to the atmosphere or to a cavity such that its overall acoustic impedance is low (e.g., approximately equal to that of air). Low acoustic impedance provides for a large electret foil displacement and thereby increased transducer sensitivity. A sintered metal backplate 30 may be preferred for the fabrication differential electret transducer arrays.

The rough metal surface 31 is in direct contact with the charged polymer layer 25 of the electret foil 20. Electret foil 20 may be held in place by the electrostatic attractive force between itself and the backplate 30, or by suitable mechanical means, such as edge clamps or adhesive. The rough surface 31 and the air channels of backplate 30 provide a compliance between the backplate 30 and the electret foil 20.

Depending on the thickness of the sintered metal backplate 30, it may be desirable to couple a metal screen 35 to it to provide increased rigidity. Like the backplate 30, it may be preferred that the screen 35 (or perforated metal) provide low acoustic impedance.

Backplate 30 may comprise materials other than a sintered metal. For example, it may comprise a porous non-metal material having a rough surface 31 which has been metalized. (The metalized surface may serve as a common electrode for the transducers of the array 10.)

Referring to electret foil 20, and specifically to metal layer 21, a plurality of discrete areas 22 are provided which are electrically unconnected from each other and the balance 23 of the metal layer. These areas 22 define the shape, size, and location of the active areas of individual electret transducers in the array 10. The active area of a transducer is that area providing electroacoustic transducer sensitivity. In addition, the areas 22 serve as electrodes for the individual electret transducers.

Areas 22 may be formed by the selective removal of the metal layer 21 from the electret foil 20 to achieve transducers of any desired shape, size, and location. In this illustrative embodiment, the selective removal of the metal layer 21 has yielded circular areas 22. Selective removal of the metal layer 21 from foil 20 for the purpose of forming areas 22 may be accomplished by etching or dissolving the metal using a chemical reagent, such as a solution sodium hydroxide (i.e., NaOH) of concentration suitable to dissolve the aluminum of layer 21. The reagent may be applied by an absorbent applicator capable of controlling the extent of reagent application on the metal surface 21 of the foil 20, such as a cotton swab or the like.

Alternatively, area 22 may be pre-formed on foil 20 prior to charging and mounting on the backplate 30. This may be done by selectively metalizing the polymer layer 25 to form a foil 20. Selective metalization may be performed by conventional metal deposition techniques (e.g., masking, evaporation, sputtering, etc.) to form areas 22 of any desired size, shape, and location. A continuous electrode foil having a polymer layer selectively charged (with either or both polarities) in defined locations may also be used.

Like the individual areas 22 defining transducer shapes, the array 10 itself may be formed of any size and shape. So, for example, the present invention may provide a single transducer of conventional shape, or a multiple transducer array curved to fit a three-dimensional contour.

Electrical leads 22' are coupled to each individual area/electrode 22. Also provided is an electrical lead 32, coupled to the backplate 30, which serves as a common lead for the transducers of the array, e.g., a common Found lead. (Leads 22' and 32 are shown as wires, but may also take the form of etched areas of metal.) By means of these leads, electrical signals produced by each transducer in response to incident acoustic signals may be accessed for amplification or other processing.

Figure 2:
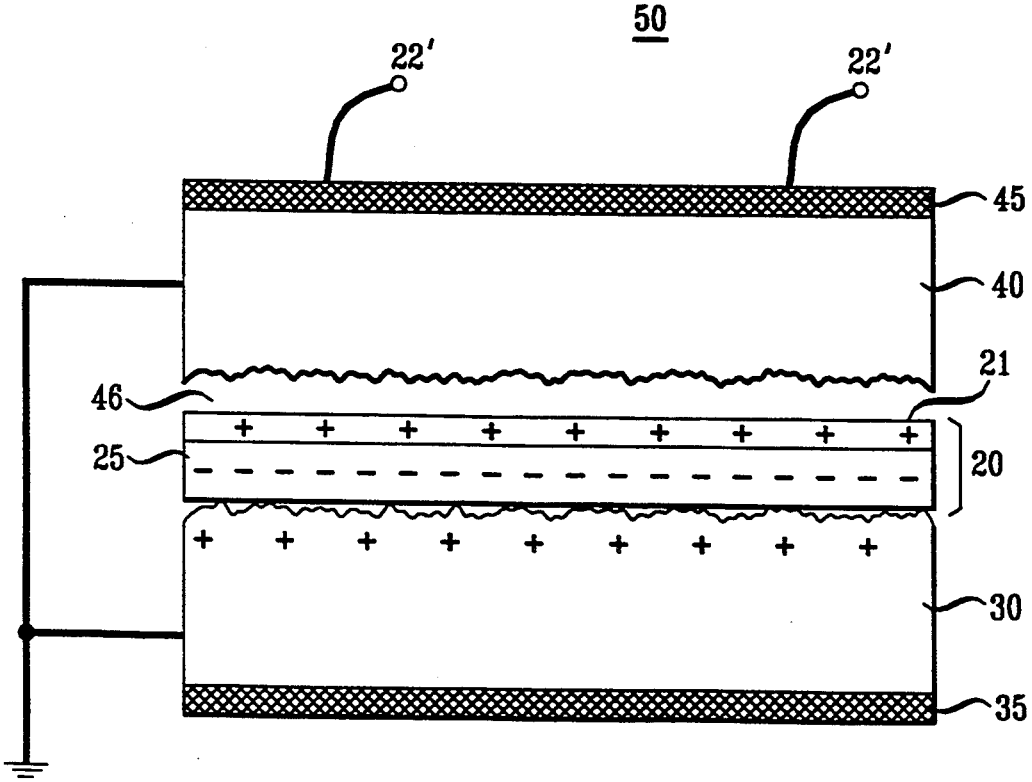
FIG. 2 presents a preferred embodiment of a differential electret transducer array according to the present invention.

A preferred embodiment for a differential electret transducer array 50 is presented in FIG. 2. This embodiment is similar to that presented in FIG. 1 and includes a second combination of a sintered metal plate 40 and a screen 45, located above the metal foil 21 forming an air-gap 46 therewith. Use of the second plate 40 and screen 45 provides shielding from the effects of stray electromagnetic fields. The second plate 40 and screen 45 also provide a symmetry of physical effects associated with incident acoustic signals on either side of the array 50.

In this embodiment, the two plates 30, 40 may be electrically coupled to each other and to ground. The "sandwich" formed by the screens 35, 45, plates, 30, 40, and electret foil 20 may be held together mechanically, e.g., by connectors (not shown), where appropriate (e.g., in the comers) for support of the array.

Figure 3:
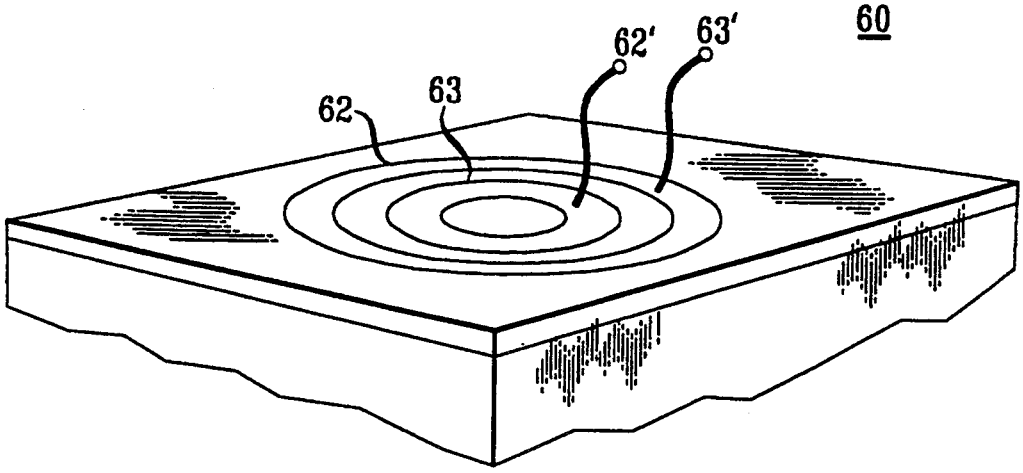
FIG. 3 presents an illustrative transducer army configuration comprising nested annuli.
Figure 4:
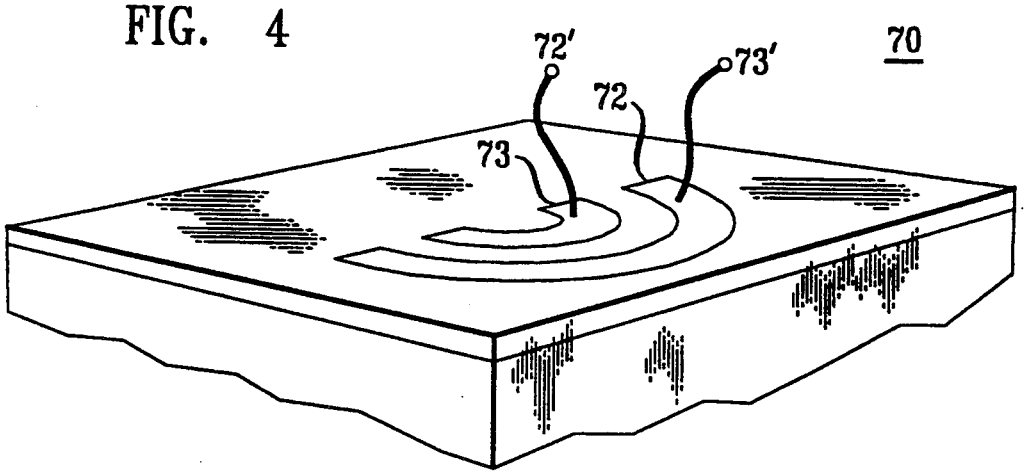
FIG. 4 presents an illustrative transducer array configuration comprising nested half-annuli.

Further illustrative electret transducer arrays 60, 70 are presented in FIGS. 3 and 4, respectively. In FIG. 3, active transducer areas defined by selective removal of metal 21 from foil 20 comprise one or more (nested) annular regions 62, 63. To each such region an electrical lead 62:, 63' is coupled. In FIG. 4, active transducer areas defined by selective removal of metal 21 from foil 20 comprise one or more (nested) portions of annuli, 72, 73; here each area is one half of an annulus. Electrical leads 72' and 73' are also presented in the Figure.

In the cases of the illustrative embodiments discussed above, an array is formed with a layer of electret foil, .wherein the polymer layer of the foil touches the rough surface of a backplate. In addition to these embodiments, the present invention is applicable to arrays formed with alternative electret transducer construction techniques, such as that presented in FIG. 5.

Figure 5:
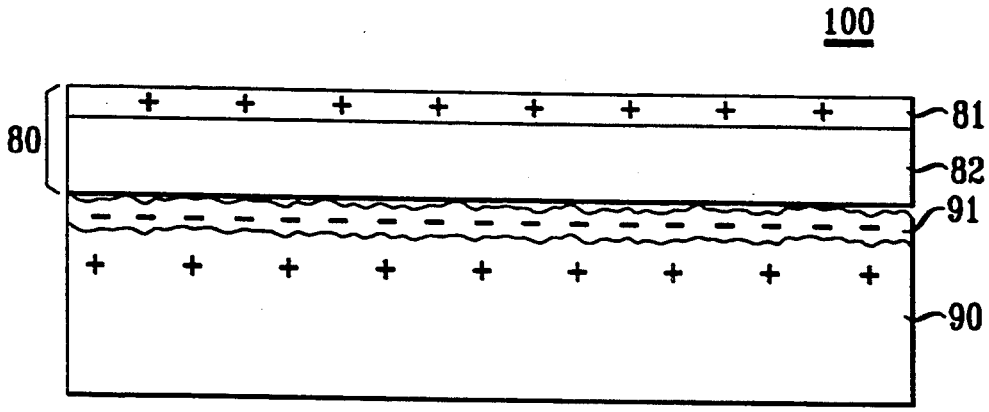
FIG. 5 presents cross-sectional view of a further illustrative electret transducer array.

FIG. 5 presents a cross-sectional view of a further illustrative electret transducer array 100 according to the present invention. Foil 80 comprises metal layer 81 and a thin (e.g., 2–200 microns) mylar layer 82. Metal has been selectively removed from metal layer 81 to form discrete electrodes (not shown) defining the size, shape, and location of active areas of one or more electret transducers (electrical leads have been left out of the Figure for clarity). Backplate 90 comprises a sintered metal. Cemented to backplate 90 is a thin (e.g., 25 microns), porous polymer layer 91 which has been charged as shown. In combination, backplate 90 and polymer layer 91 provide numerous air channels throughout their combined volume, including air channels which open onto the rough surface of layer 91. Porous polymer layer 91 may be formed by applying a thin polymer to a sintered backplate 90, and drawing channels through the layer 91 by application of a high vacuum to the opposite side of the backplate 90. Mylar layer 82 is in contact with the rough surface of the porous, charged polymer 91. In this embodiment, backplate 90 may serve as a common electrode for each transducer of the array 100, while the discrete areas of metal layer 81 form opposite polarity electrodes for each transducer.

We claim:

1. A foil for use in a transducer array comprising one or more transducers, the foil comprising:

a layer of insulating material; and a layer of metal in contact with the layer of insulating material, wherein the layer of metal comprises a plurality of physically discrete areas of metal, one or more of the discrete areas defining areas which convert between acoustic and electric energy by variation of capacitance of one or more transducers of the array when the foil is used in said transducer array.

2. The foil of claim 1 wherein an area of metal defines the shape of a transducer in the array.

3. The foil of claim 1 wherein the layer of insulating material is electrostatically charged.

4. The foil of claim 1 wherein the layer of insulating material comprises a polymer.

5. The foil of claim 4 wherein the polymer comprises TEFLON.

6. The foil of claim 1 wherein the areas which convert between acoustic and electric energy comprise one or more annuli.

7. The foil of claim 1 wherein the areas which convert between acoustic and electric energy comprise one or more portions of annuli.

8. A transducer array comprising:

a. a first backplate, the first backplate comprising a rough metal surface; and b. a foil disposed at a predetermined position with respect to the first backplate, the foil comprising i. a layer of insulating material, and ii. a layer of metal, wherein the layer of metal comprises a plurality of physically. discrete areas of metal, one or more of the discrete areas of metal defining areas which convert between acoustic and electric energy in one or more transducers of the array.

9. The array of claim 8 wherein the layer of insulating material is electrostatically charged.

10. The array of claim 8 wherein the foil is positioned such that the insulating layer is in contact with the metal surface of the first backplate.

11. The array of claim 10 wherein there are one or more air-gaps between the insulating layer and the metal surface of the first backplate.

12. The army of claim 8 further comprising an electric lead coupled to a discrete area of metal.

13. The array of claim 8 further comprising an electric lead coupled to the metal surface of the first backplate.

14. The array of claim 8 wherein the first backplate comprises a porous material.

15. The array of claim 14 wherein the porous material comprises a sintered metal.

16. The array of claim 14 wherein the porous material provides low acoustic impedance.

17. The array of claim 8 wherein the first backplate further comprises an insulating material.

18. The array of claim 8 further comprising a screen coupled to the first backplate.

19. The array of claim 18 wherein the screen provides low acoustic impedance.

20. The array of claim 18 further comprising an insulating material applied to the first backplate, the insulating material being electrostatically charged.

21. The array of claim 20 wherein the foil is positioned to be in contact with the insulating material applied to the first backplate.

22. The array of claim 8 further comprising a second backplate, coupled the first backplate, the foil disposed between the first backplate and the second backplate.

23. The array of claim 22 wherein the first and second backplates are electrically coupled.

24. The array of claim 22 wherein the second backplate comprises a porous material.

25. The array of claim 24 wherein the porous material of the second backplate provides a low acoustic impedance.

26. The array of claim 22 further comprising a screen coupled to the second backplate.

27. An electret transducer array comprising:

a. a backplate, the backplate comprising a rough metal surface; and b. an electret foil disposed at a predetermined position with respect to the backplate, the electret foil comprising:

a layer of insulating material, the layer of insulating material selectively charged with a first polarity at a plurality of physically discrete areas, and ii. a layer of metal.

28. The electret transducer array of claim 27 wherein the backplate further comprises a layer of insulating material, applied to the rough metal surface, selectively charged at one or more areas thereof and wherein the electret foil is disposed to be in contact with the layer of insulating material of the backplate.

29. An electret transducer array comprising:

a. a first backplate, the first backplate comprising a rough metal surface; and b. a foil, the foil comprising:

i. a layer of electrostatically charged insulating material, and ii. a layer of metal, wherein the layer of metal comprises a plurality of physically discrete areas of metal which define areas which convert between acoustic and electric energy in one or more transducers of the array;

the foil positioned such that the layer of insulating material is in contact with the metal surface of the first backplate and held in position by electrostatic force between itself and the first backplate.

30. The array of claim 29 wherein the first backplate comprises a porous material.

31. The array of claim 29 further comprising a second backplate, coupled the first backplate, the foil disposed between the first backplate and the second backplate.

32. The array of claim 31 wherein the first and second backplates are electrically coupled.

33. The array of claim 31 wherein the second backplate comprises a porous material.

34. A transducer array comprising:

a. a first backplate, the first backplate comprising a rough metal surface; and b. a foil disposed at a predetermined position with respect to the first backplate, the foil comprising:

i. a layer of insulating material, and ii. a layer of metal, wherein the layer of metal comprises a plurality of physically discrete areas of metal, one or more of the discrete areas of metal defining areas which convert between acoustic and electric energy by variation of capacitance of one or more transducers of the array.

35. An electret transducer array comprising:

a. a first backplate, the first backplate comprising a rough metal surface; and b. a foil, the foil comprising:

i. a layer of electrostatically charged insulating material, and ii. a layer of metal, wherein the layer of metal comprises a plurality of physically discrete areas of metal, one or more of the discrete areas of metal defining areas which convert between acoustic and electric energy by variation of capacitance of one or more transducers of the array;

the foil positioned such that the layer of insulating material is in contact with the metal surface of the first backplate and held in position by electrostatic force between itself and the first backplate.

* * * * *